US009283454B2

(12) United States Patent
Bond

(10) Patent No.: US 9,283,454 B2
(45) Date of Patent: Mar. 15, 2016

(54) SPORTS EQUIPMENT STICK HANDLE

(75) Inventor: Jonathan Bond, Silver Spring, MD (US)

(73) Assignee: WM. T. Burnett IP, LLC, Baltimore, MD (US)

( * ) Notice: Subject to any disclaimer, the term of this patent is extended or adjusted under 35 U.S.C. 154(b) by 1133 days.

(21) Appl. No.: 12/767,199

(22) Filed: Apr. 26, 2010

(65) Prior Publication Data

US 2011/0263360 A1 Oct. 27, 2011

(51) Int. Cl.

| | |
|---|---|
| ***A63B 59/02*** | (2006.01) |
| ***A63B 59/00*** | (2015.01) |
| *A63B 59/14* | (2006.01) |

(52) U.S. Cl.

CPC ..... *A63B 60/08* (2015.10); *A63B 59/0014* (2013.01); *A63B 60/06* (2015.10); *A63B 60/10* (2015.10); *A63B 59/02* (2013.01); *A63B 59/14* (2013.01); *A63B 59/20* (2015.10); *A63B 59/70* (2015.10); *A63B 2102/24* (2015.10); *A63B 2209/00* (2013.01); *A63B 2209/023* (2013.01)

(58) Field of Classification Search

CPC ..... A63B 59/02
USPC ..... 473/505, 512, 513; D21/724
See application file for complete search history.

(56) References Cited

U.S. PATENT DOCUMENTS

| | | | | | |
|---|---|---|---|---|---|
| 1,928,009 | A | * | 9/1933 | Dornier | 138/177 |
| 1,930,285 | A | * | 10/1933 | Robinson | 138/143 |
| 1,963,057 | A | * | 6/1934 | Wilcox | 29/897.33 |
| 3,702,702 | A | * | 11/1972 | Hoult | 473/513 |
| 3,972,529 | A | * | 8/1976 | McNeil | 473/320 |
| D245,756 | S | * | 9/1977 | McKee | D8/376 |
| 4,739,994 | A | * | 4/1988 | Lewis, Jr. | 473/513 |
| 5,749,798 | A | * | 5/1998 | Kuebler et al. | 473/549 |
| 6,752,730 | B1 | * | 6/2004 | Brine et al. | 473/513 |
| 7,201,678 | B2 | * | 4/2007 | Filice et al. | 473/513 |
| D581,474 | S | * | 11/2008 | Dickie et al. | D21/757 |

OTHER PUBLICATIONS

Webpage download, hautestick, 2001, http://replay.waybackmachine.org/200101141923/http://www.hautestick.com/LaxGear/LaxShaft/HyperImpact/SM2 -C/SS-Map.htm, xx pages.*

* cited by examiner

*Primary Examiner* — Gene Kim
*Assistant Examiner* — Michael Chambers
(74) *Attorney, Agent, or Firm* — Ober, Kaler, Grimes & Shriver; Royal W. Craig

(57) ABSTRACT

A sports equipment stick handle comprising a hollow tubular member with a cross section comprising at least a first wall and a second wall that intersect at a corner having a reinforcement portion (fillet, bead or diagonal; easement, wherein the thickness of the corner is greater than the thickness of the first and second walls. The reinforcement portion increases dent resistance, strength, and stiffness.

2 Claims, 3 Drawing Sheets

SPORTS EQUIPMENT STICK HANDLE

BACKGROUND OF THE INVENTION

1. Field of the Invention

The present invention relates to sports equipment and, particularly, to sports equipment stick handles.

2. Description of the Background

A sports equipment stick generally comprises an operational head joined to a handle on which the player places his hands. The head, for example, the head of a lacrosse stick or the blade of a hockey stick, refers generally to that part or parts of the sports equipment stick that is/are controlled by the handle. As used herein, "stick" refers to the stick as a whole, including the operational head and the handle.

To execute game skills, a player controls the sports equipment stick by grabbing and maneuvering the handle. In some sports, such as hockey and lacrosse, this control is referred to as "stick handling," and game skills that involve stick handling include passing, shooting, checking, cradling, carrying, and scooping ground balls. For improved stick handling, it is generally desirable that the stick be light weight. A light weight stick provides improved ball sensitivity, allows quicker stick movement, reduces player fatigue, and provides better stick balance. The stick's weight can be decreased by decreasing the weight of the handle. To decrease the handle weight, either a lighter material must be used or the wall thickness must be decreased. Both options entail compromises.

Decreasing the wall thickness also decreases the handle's strength, rigidity, and durability. Conventional stick handles comprise hollow metal tubes of aluminum, titanium, or other suitable strong lightweight alloys. Lacrosse stick handles generally have an octagonal cross section with uniform wall thickness. Given the octagonal shape, handle-on-handle impacts are almost always edge-to-edge impacts (it is rare that the impacting handles are perfectly aligned to result in a flat-side-surface impact). While executing game skills, it is common for one player's stick to strike another player's stick, whether intentionally or inadvertently. For example, a player executes a stick check to dislodge a ball from an opponent by intentionally striking the opponent's stick with the player's own stick. Often times, these strikes result in handle-on-handle impacts. The handle must have a substantial degree of strength, rigidity, and durability to withstand these impacts and resist dents (that lead to handle failure) while also minimizing stick weight for stick handling.

There is therefore a need in the art for an improved sports equipment stick handle that has the necessary strength to withstand handle-on-handle impacts, but also minimizes the handle's weight for superb stick handling. There is also a need in the art for an improved sports equipment stick handle that has increased strength to withstand handle-on-handle impacts while maintaining a similar weight to conventional handles.

SUMMARY OF THE INVENTION

One aspect of the present invention provides a sports equipment stick handle comprising a tubular member having a cross section that makes the handle less likely to fail from edge-to-edge impact than a conventional stick handle, having uniform wall thickness, of equal weight and the same material.

Another aspect of the present invention provides a sports equipment stick handle comprising a tubular member having a cross section that makes the handle weigh less than a conventional stick handle, having uniform wall thickness, of equal strength and durability, and made from the same material.

Another aspect of the present invention provides a sports equipment stick handle comprising a tubular member having a cross section that maintains the weight of a conventional stick handle having uniform wall thickness, but has increased strength and durability and is made from the same material.

An embodiment of the present invention provides a sports equipment stick handle comprising a tubular shaft having a cross section comprising at least a first wall and a second wall that intersect at a corner, the corner having at least one reinforcement portion, wherein the thickness of the corner is greater than the thickness of the first or second walls.

In a specific implementation of a sports equipment stick handle having a cross section according to an embodiment of the present invention, the cross section is an octagon with eight walls that intersect at eight corners. Each corner further comprises an interior reinforcement portion that projects into the hollow cavity. The interior contour of each reinforcement portion is an arc with a large radius. The reinforcement portions provide more material at the edges of the handle, which increase dent resistance for handle-on-handle impacts, strength, and stiffness.

Another embodiment of the present invention provides a sports equipment stick handle comprising a tubular shaft having a cross section comprising at least a first wall and a second wall that intersect at a corner, the corner having at least one reinforcement portion projecting outward from the handle's exterior profile, wherein the thickness of the corner is greater than the thickness of the first or second walls.

Yet another embodiment of the present invention provides a sports equipment stick handle comprising a tubular shaft having a cross section comprising at least a first wall and a second wall that intersect at a corner, the corner having at least one reinforcement portion projecting into the cavity and at least one reinforcement portion projecting outward from the handle's exterior profile, wherein the thickness of the corner is greater than the thickness of the first or second walls.

In other embodiments, the reinforcement portions have other contours such as a small radius bead or a straight line.

In other embodiments, the cross section takes on other shapes such as other polygons, for example, triangles, quadrilaterals, pentagons, and others, or curvilinear shapes such as tear drops (a hexagonal top portion with an elliptical, oval, or circular bottom portion) or semi-circles.

In an embodiment, the cross section is substantially uniform along the length of the sports equipment stick. In another embodiment, the corners have variable thickness along the length of the sports equipment stick.

In an embodiment of the present invention, the handle is constructed of a metal or metal alloy, for example, formed by extruding, casting, or hydroforming. The metal or metal alloy can be, for example, Titanium, a Titanium alloy, a Magnesium alloy, an Aluminum-Magnesium-Silicon alloy, an Aluminum-Zinc alloy, high strength Aluminum-Zinc alloys incorporating Magnesium, Vanadium, Titanium, and/or Scandium, or a Vanadium-steel alloy, a Vanadium-Aluminum alloy, a Titanium-Aluminum alloy, a Titanium-Scandium alloy, or a Scandium-Aluminum alloy.

In another embodiment of the present invention, the handle is constructed of a composite material, for example, formed by bladder molding, roll wrapping, foam core molding, filament winding, or pultrusion.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

An embodiment of the present invention provides a sports equipment stick handle comprising a tubular member with a cross section comprising at least a first wall and a second wall that intersect at a corner and having a reinforcement portion occupying the inner juncture of said walls, which makes the thickness of the corner greater than the thickness of the first or second walls. The reinforcement portion may be a concave easement ("fillet"), convex easement ("bead"), or diagonal easement.

Figure 1:
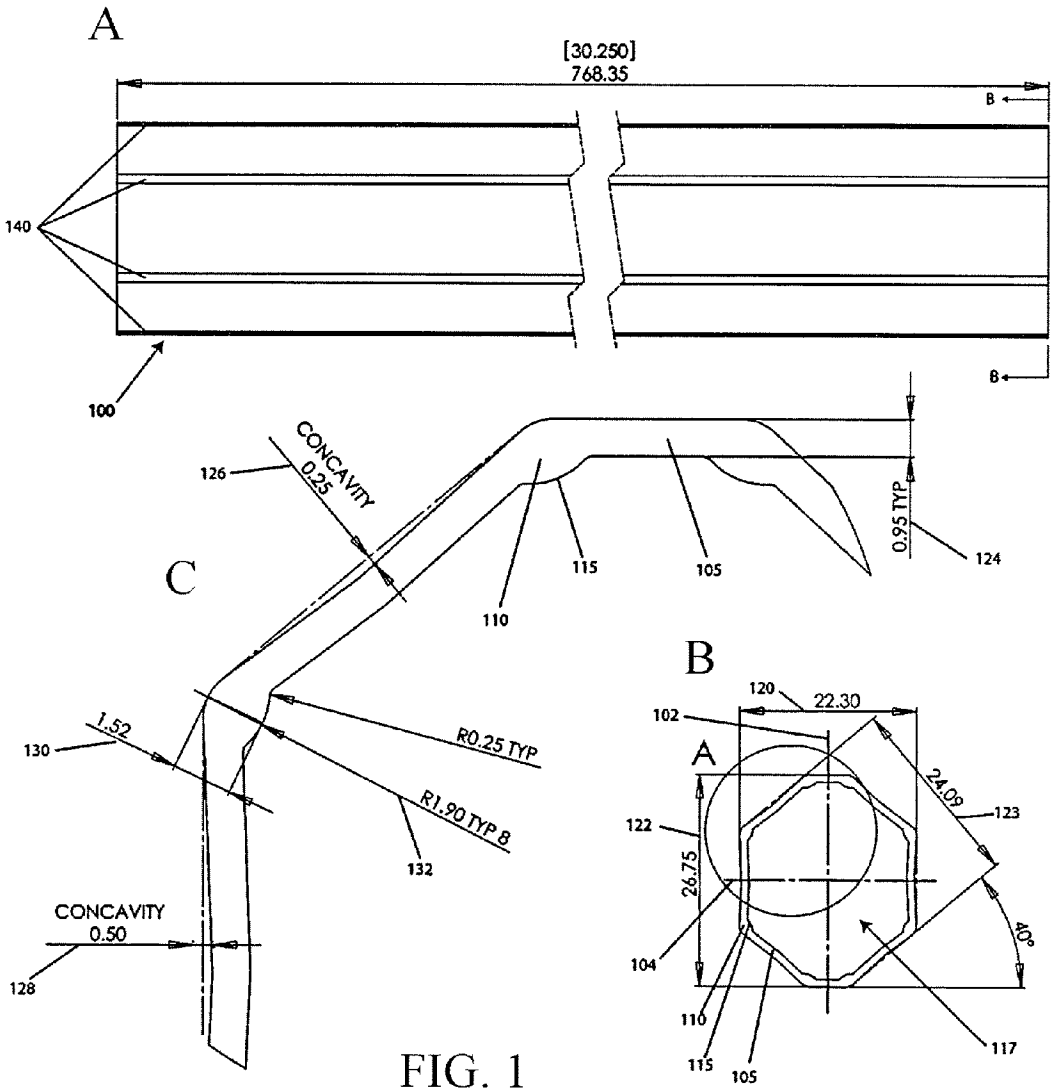
FIG. 1A is a schematic diagram of a plan view of a sports equipment stick handle according to an embodiment of the present invention.
FIG. 1B is a schematic diagram of the cross section B-B of the handle of FIG. 1A.
FIG. 1C is a schematic diagram of an enlarged portion of the cross section of FIG. 1B.

FIGS. 1A-1C illustrate a specific implementation of a sports equipment stick handle 100 according to an embodiment of the present invention. In this embodiment, the sports equipment stick handle generally comprises a tubular member with a cross section comprising at least a first wall and a second wall that intersect at a corner having an interior reinforcement portion that projects into the hollow cavity, making the thickness of the corner is greater than the thickness of either the first or second walls. Specifically, the handle 100 comprises a tubular member with a concave, octagonal cross section comprising eight walls 105 that intersect at eight corners 110. Each corner 110 further comprises an interior reinforcement portion 115 that projects into the hollow cavity 117. The width 120 of the handle can be about 22.3 mm, for example, and its height 122 can be about 26.75 mm, for example. The diagonal width 123 of the handle can be about 24.09 mm, for example. The handle walls 105 have a uniform thickness 124 that can be about 0.95 mm, for example. The top and bottom walls are generally flat. The diagonal walls have a concavity 126 that can be about 0.25 mm, for example. The side walls have a concavity 128 that can be about 0.50 mm, for example. Each corner 110, including the reinforcement portion 115, has a uniform thickness 130 that can be about 1.52 mm, for example. The contour of each reinforcement portion 115 is an arc with a large radius 132 that can be about 1.90 mm, for example.

The reinforcement portions 115 provide more material at the edges 140 of the handle 100, which increase dent resistance for handle-on-handle impacts. In a dent resistance test using an air-cylinder-driven impact tip, a handle according to the embodiment of FIGS. 1A-1C made of a 7075 series Aluminum alloy showed a 13% to 38% reduction in dent depth for impacts along the top flat wall 105 and adjacent corners 110 when compared to an equal weight conventional handle, having uniform wall thickness of approximately 1 mm, and made of a stronger, more expensive 7000 series Aluminum-Scandium alloy:

| Cylinder Pressure (psi) | Avg. Dent Depth of Conventional Handle (mm) | Avg. Dent Depth of Embodiment of Present Invention (mm) | Delta |
|---|---|---|---|
| 30 | 0.200 | 0.125 | 38% |
| 40 | 0.415 | 0.360 | 13% |
| 50 | 0.820 | 0.510 | 38% |

The reinforcement portions 115 also make the handle 100 stiffer and stronger by increasing the moment of inertia (second moment of area) of the cross section. For example, the second moment ($I_y$) with respect to the y-axis 102 of a conventional handle having uniform wall thickness of approximately 1 mm is 3.9% lower than the second moment of a handle 100 according to the embodiment of FIGS. 1A-1C; the second moment ($I_x$) with respect to the x-axis 104 of a conventional handle is 1.3% lower than the second moment of the handle 100.

| Moment of Inertia/Second moment of area | | | |
|---|---|---|---|
| | Conventional | Beaded | Delta |
| $I_x$ | 4696.6 | 4758.7 | −1.3% |
| $I_y$ | 5836.7 | 6063.0 | −3.9% |

Accordingly, when compared to the conventional handle, the handle 100 according to this implementation is approximately 3-5% stiffer and has 4-7% lower stresses in certain loading scenarios. For example, in a quasi-static 4-point bend test, a handle according to the embodiment of FIGS. 1A-1C made of a 7075 series Aluminum alloy showed a 3.9% increase in its weight-normalized peak load over conventional handles of the same material:

| Handle | Weight (g) | Delta | Avg. Max Load (lbf) | Delta | Strength/ Weight | Delta |
|---|---|---|---|---|---|---|
| Embodiment of Present Invention | 161.2 | 0% | 643 | 0% | 3.987 | 0% |
| Conventional Handle 1 | 158.1 | 2.0% | 607 | 5.9% | 3.837 | 3.9% |
| Conventional Handle 2 | 164.8 | −2.2% | 610 | 5.3% | 3.837 | 3.9% |

By having reinforcement portions 115 at the corners 110, the player gains the benefit of having thicker walls, without the added weight of uniformly increasing the wall thickness.

Figure 2:
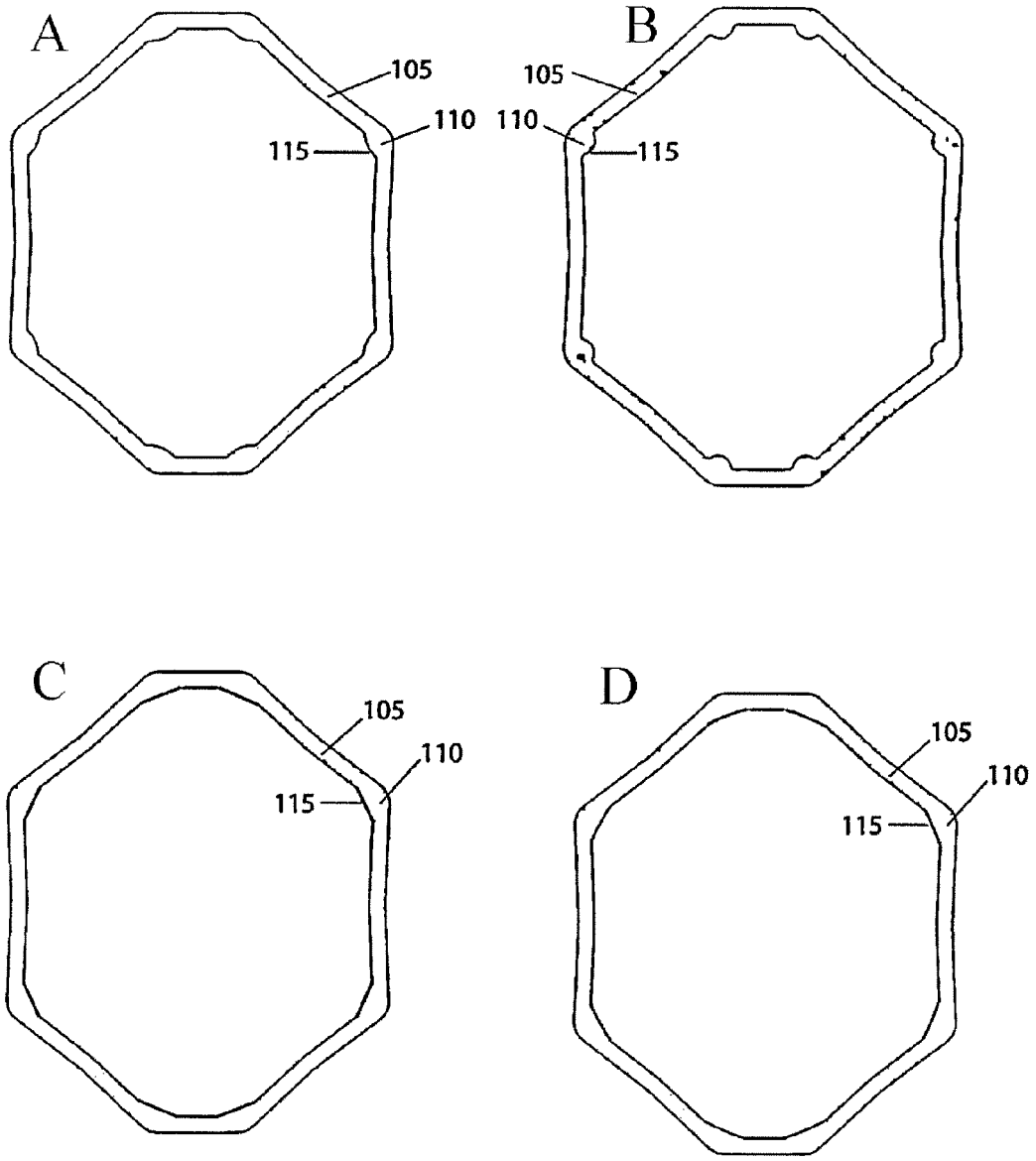
FIG. 2A is a schematic diagram of a cross section of a sports equipment stick handle according to an embodiment of the present invention.
FIG. 2B is a schematic diagram of a cross section of a sports equipment stick handle according to an embodiment of the present invention.
FIG. 2C is a schematic diagram of a cross section of a sports equipment stick handle according to an embodiment of the present invention.
FIG. 2D is a schematic diagram of a cross section of a sports equipment stick handle according to an embodiment of the present invention.

FIGS. 2A-D illustrate cross sections of implementations of a sport equipment stick handle 100 according to another embodiment of the present invention. In FIG. 2A, the contour of the reinforcement portion 115 is a large radius arc. In FIG. 2B, the contour of the reinforcement portion 115 is a small radius bead, and the contour of the reinforcement portion 115 in FIG. 2C is a straight line. In FIG. 2D, the contour of the reinforcement portion 115 is a shallow convex arc or fillet.

In all of FIGS. 1A-1C and 2A-2C the reinforcement portion (elongate fillet, bead, etc.) is formed along the inner junctures of each pair of intersecting walls for reinforcement, and occupies an area bounded by the included angle of said walls. The reinforcement portions may be formed as shallow convex projections, concave easements, or diagonal easements of the interior corners of the handle, making the thickness of the handle corner (measured along a radii to the axis of the handle) greater than the thickness of the flanking walls. Additionally, two or more of the intersecting wall sections (flanking each reinforcement portion) are preferably formed with a slight inward concavity. The foregoing design features combine synergistically to add strength and durability.

Figure 3:
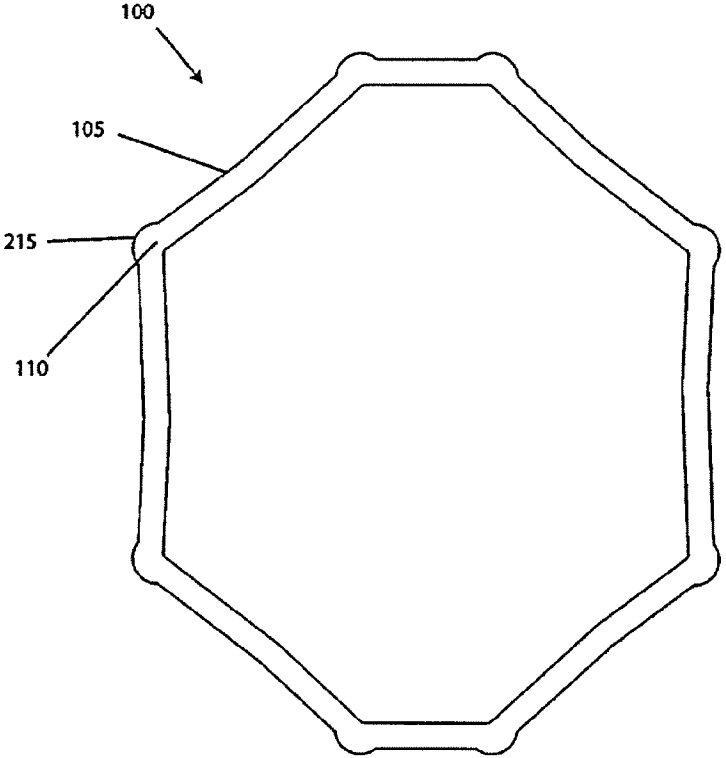
FIG. 3 is a schematic diagram of a cross section of a sports equipment stick handle according to an embodiment of the present invention.

FIG. 3 illustrates a cross section of another implementation of a sports equipment stick handle 100 according to an embodiment of the present invention. In this implementation, the sports equipment stick handle generally comprises a tubular member with a cross section comprising at least a first wall and a second wall that intersect at a corner having an exterior reinforcement portion that projects outward from the handle's exterior profile, wherein the thickness of the corner is greater than the thickness of either the first or second walls. Specifically, the cross section of handle 100 comprises a tubular member with a concave, octagonal cross section comprising eight walls 105 that intersect at eight corners 110. Each corner 110 further comprises an exterior reinforcement portion 215 that projects outward from the handle's exterior profile walls 105. The dimensions, areas, and proportions are similar to those shown and described above.

Figure 4:
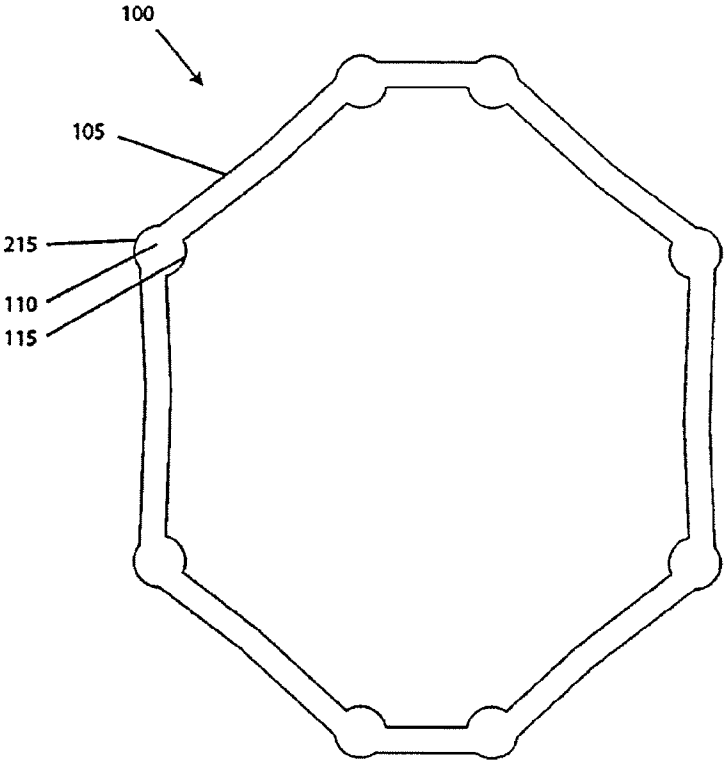
FIG. 4 is a schematic diagram of a cross section of a sports equipment stick handle according to an embodiment of the present invention.

FIG. 4 illustrates a cross section of still yet another implementation of a sports equipment stick handle 100 according to an embodiment of the present invention. In this implementation, the sports equipment stick handle generally comprises a tubular member with a cross section comprising at least a first wall and a second wall that intersect at a corner having an interior reinforcement portion that projects into the hollow cavity and an exterior reinforcement portion that projects outward from the handle's exterior profile, wherein the thickness of the corner is greater than the thickness of either the first or second walls. Specifically, the cross section of handle 100 comprises a tubular member with a concave, octagonal cross section comprising eight walls 105 that intersect at eight corners 110. Each corner 110 further comprises an interior reinforcement portion 115 that projects into the handle's hollow cavity, and an exterior reinforcement portion 215 that projects outward from the handle's exterior profile—walls 205. The dimensions, areas, and proportions are similar to those shown and described above.

Although FIGS. 1A-C, 2A-C, 3, and 4 depict particular cross sections or open ends, the invention is not limited to the particular depicted shapes, dimensions, areas, or proportions. Indeed, the present invention could incorporate other cross-sectional shapes such as other polygons, for example, triangles, quadrilaterals, pentagons, and others, or curvilinear shapes such as tear drops (a hexagonal top portion with an elliptical, oval, or circular bottom portion) or semi-circles. Therefore, notwithstanding the particular benefits associated with the shapes, dimensions, areas, and proportions shown and described herein, the present invention should be considered broadly applicable to any sports equipment stick handle having a tubular shaft.

Additionally, although embodiments shown in the figures show wall concavity, the invention encompass a sports equipment stick handle that has straight or flat walls or convex walls. The invention is therefore not limited to any particular wall concavity.

Further, although embodiments shown in the figures show the contour of the reinforcement portions to be either a large radius arc, small radius bead, or a straight line, the invention is not limited to the particular depicted contour, shape, path, or profile. Indeed, the present invention could incorporate other contours such as elliptic beads, curvilinear shapes, or polygonal shapes.

Overall, embodiments of the present invention provide a sports equipment stick handle with a cross section comprising at least a first wall and a second wall that intersect at a corner having a reinforcement portion, wherein the thickness of the corner is greater than the thickness of the first or second walls. The greater corner thickness affords significant, unexpected benefits to a sports equipment stick.

A sports equipment stick handle according to an embodiment of the present invention will have better dent resistances at its edges, strength, and stiffness than a conventional handle of uniform wall thickness of equal weight. Accordingly, improvement in structural characteristics is achieved without sacrificing stick handling characteristics dependent on stick weight. Additionally, a sports equipment stick handle according to an embodiment of the present invention weighs less than a conventional handle, having uniform wall thickness, with the same structural characteristics. Accordingly, a light stick can be used without sacrificing strength and durability. Additionally, a sports equipment stick handle according to an embodiment of the present invention weighing the same as a conventional handle, having uniform wall thickness, demonstrates increased structural characteristics.

The overall structure of the handle can also vary in outer dimensions or profile to improve the gripping of the lacrosse stick. For example, the outer dimensions could increase toward the end of the sports equipment stick handle, providing a substantially conical shape at the end of the handle.

In an embodiment, the cross section is substantially uniform along the length of the sports equipment stick. In another embodiment, the corners have variable thickness and shape along the length of the sports equipment stick. The portions of increased corner thickness can provide strength to desired locations of the handle. The corner thickness can be increased in one location or in multiple locations.

In an embodiment, the handle is constructed of a metal or metal alloy, for example, Titanium, Magnesium, an Aluminum-Magnesium-Silicon alloy, an Aluminum-Zinc alloy, high strength Aluminum-Zinc alloys incorporating Magnesium, Vanadium, Titanium, and/or Scandium, a Zirconium-Aluminum alloy, a Vanadium-steel alloy, a Vanadium-Aluminum alloy, a Titanium-Aluminum alloy, a Titanium-Scandium alloy, or a Scandium-Aluminum alloy. More specific examples of usable alloys include a 6000 series Aluminum-Magnesium-Silicon alloy, a 7000 series Aluminum-Zinc alloy, and high strength 7000 series Aluminum-Zinc alloys incorporating Magnesium, Vanadium, Titanium, and/or Scandium.

In an embodiment of the present invention, sports equipment stick handles are formed by extruding. Further embodiments of the present invention form the handle using any of the following methods or combinations thereof: hydroforming, casting metal in a mold, sand casting, injection molding, forging, and machining, and with composites, the present invention may be formed by bladder molding, roll wrapping, foam core molding, filament winding, and pultrusion.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

What is claimed is:

1. A sports equipment stick handle, comprising:

a tubular shaft having a polygonal cross section defined by a plurality of elongate wall sections integrally joined at a corresponding plurality of linear junctures, thereby defining a corresponding plurality of elongate corners running end-to-end, said tubular shaft having a corresponding plurality of reinforcing fillets occupying an included angle of each of said corners from end-to-end and increasing a thickness of shaft at said corner in excess of a thickness of said first and second walls.

2. A sports equipment stick handle, comprising:

a tubular shaft having a polygonal cross section defined by a plurality of elongate wall sections integrally joined at a corresponding plurality of linear junctures, thereby defining a corresponding plurality of elongate corners running end-to-end, said tubular shaft having a corresponding plurality of reinforcing beads occupying an included angle of each of said corners from end-to-end and increasing a thickness of shaft at said corner in excess of a thickness of said first and second walls.

* * * * *